US008147355B2

(12) United States Patent
Burgess

(10) Patent No.: US 8,147,355 B2
(45) Date of Patent: Apr. 3, 2012

(54) ROCKET TEE, A BASEBALL OR SOFTBALL HITTERS TRAINING SYSTEM FOR THE PURPOSE OF BATTING PRACTICE

(76) Inventor: Michael Kent Burgess, La Habra, CA (US)

( * ) Notice: Subject to any disclaimer, the term of this patent is extended or adjusted under 35 U.S.C. 154(b) by 0 days.

(21) Appl. No.: 12/800,277

(22) Filed: May 12, 2010

(65) Prior Publication Data

US 2011/0092317 A1 Apr. 21, 2011

(51) Int. Cl.
*A63B 69/00* (2006.01)

(52) U.S. Cl. ..... 473/417; 473/451

(58) Field of Classification Search ..... 473/417, 473/431, 418–420, 451, 422; D21/715, 780
See application file for complete search history.

(56) References Cited

U.S. PATENT DOCUMENTS 3,863,920 A * 2/1975 Tassone et al. ..... 473/417
4,533,138 A * 8/1985 Rodriguez et al. ..... 473/417
7,226,372 B2 * 6/2007 Flanigan ..... 473/431
7,255,658 B1 * 8/2007 VanKuiken et al. ..... 473/454
7,641,573 B2 * 1/2010 Cech ..... 473/451
7,674,194 B2 * 3/2010 Lortscher ..... 473/417
2006/0264273 A1 * 11/2006 Liao ..... 473/417
2007/0275793 A1 * 11/2007 Liao ..... 473/417
2008/0085787 A1 * 4/2008 Molloy et al. ..... 473/417
2008/0132362 A1 * 6/2008 Brazzano ..... 473/452
2009/0149279 A1 * 6/2009 Fischer et al. ..... 473/417
2009/0312123 A1 * 12/2009 Liao ..... 473/417
2011/0092317 A1 * 4/2011 Burgess ..... 473/417

* cited by examiner

*Primary Examiner* — Mitra Aryanpour

(57) ABSTRACT

The present invention and method is a training system for baseball and softball batters containing but not limited to a manually operated mobile batting tee and an illustrated board on which the tee is maneuvered. The operator is positioned at the opposite end of the board from home plate. The device is operated by placing a ball on the bristled head and using the adjustable handle to push the mobile tee to marked locations where the ball is then hit by the batter. After the ball is struck the operator pulls the tee back to it's original location where another ball is loaded and the cycle is repeated. Ball elevation is adjusted by releasing the tension device and moving the stem up or down. For young players the device with ball can be placed in front of home plate and pulled rearward to simulate a pitched ball.

9 Claims, 4 Drawing Sheets

ROCKET TEE, A BASEBALL OR SOFTBALL HITTERS TRAINING SYSTEM FOR THE PURPOSE OF BATTING PRACTICE

DESCRIPTION LIST

Figure 1:
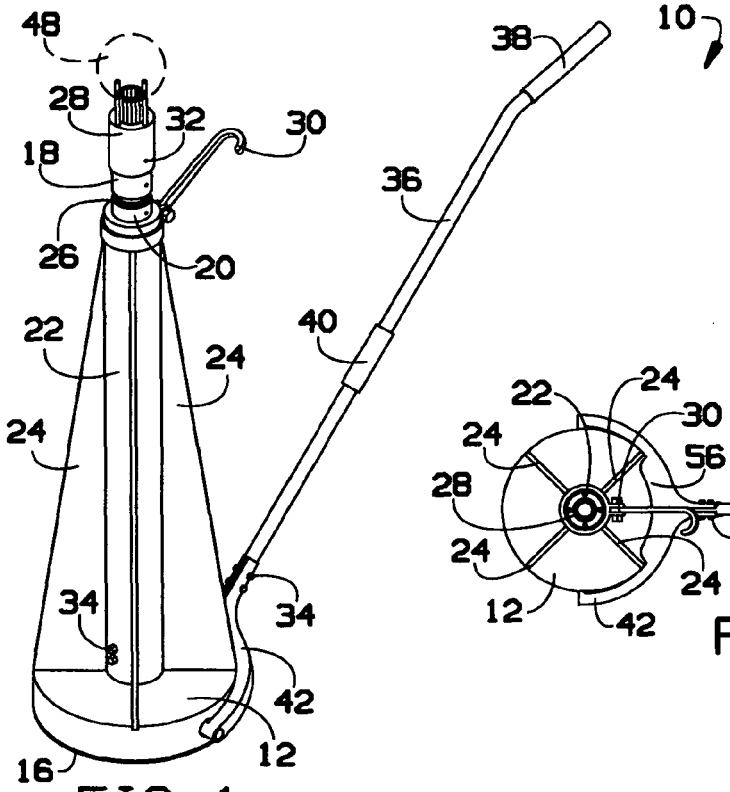
FIG. 1 is a perspective view of an exemplary embodiment of the Invention (ball 48 shown in phantom to avoid hiding detail)
Figure 3:
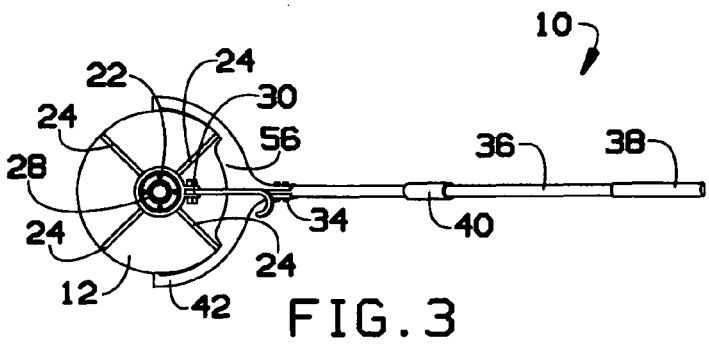
FIG. 3 is a top view of an exemplary embodiment of the invention (ball 48 omitted for clarity)
Figure 4:
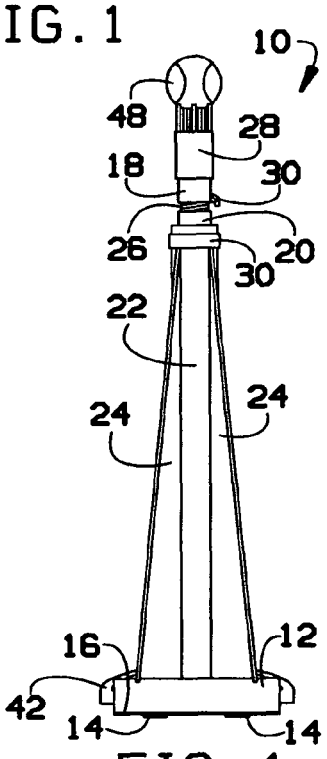
FIG. 4 is a front view of an exemplary embodiment of the invention.
Figure 5:
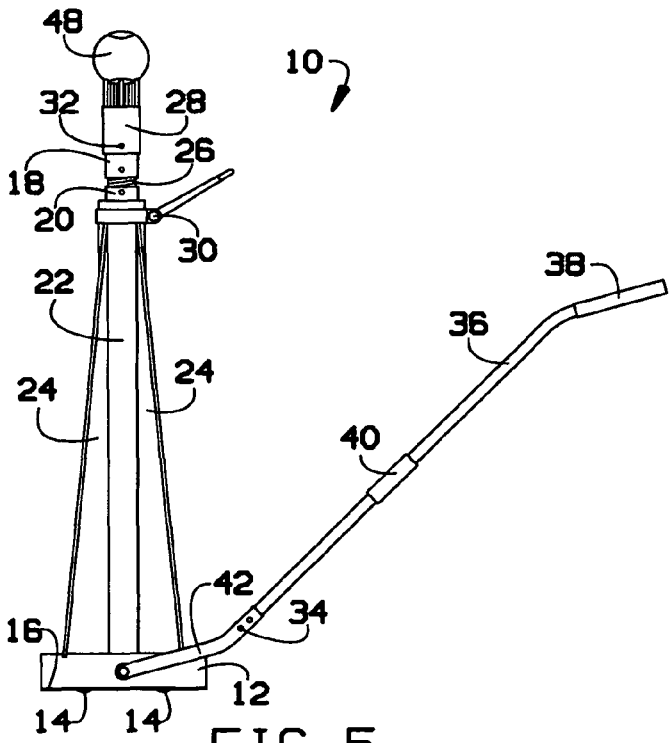
FIG. 5 is a side view of an exemplary embodiment of the invention.
Figure 2:
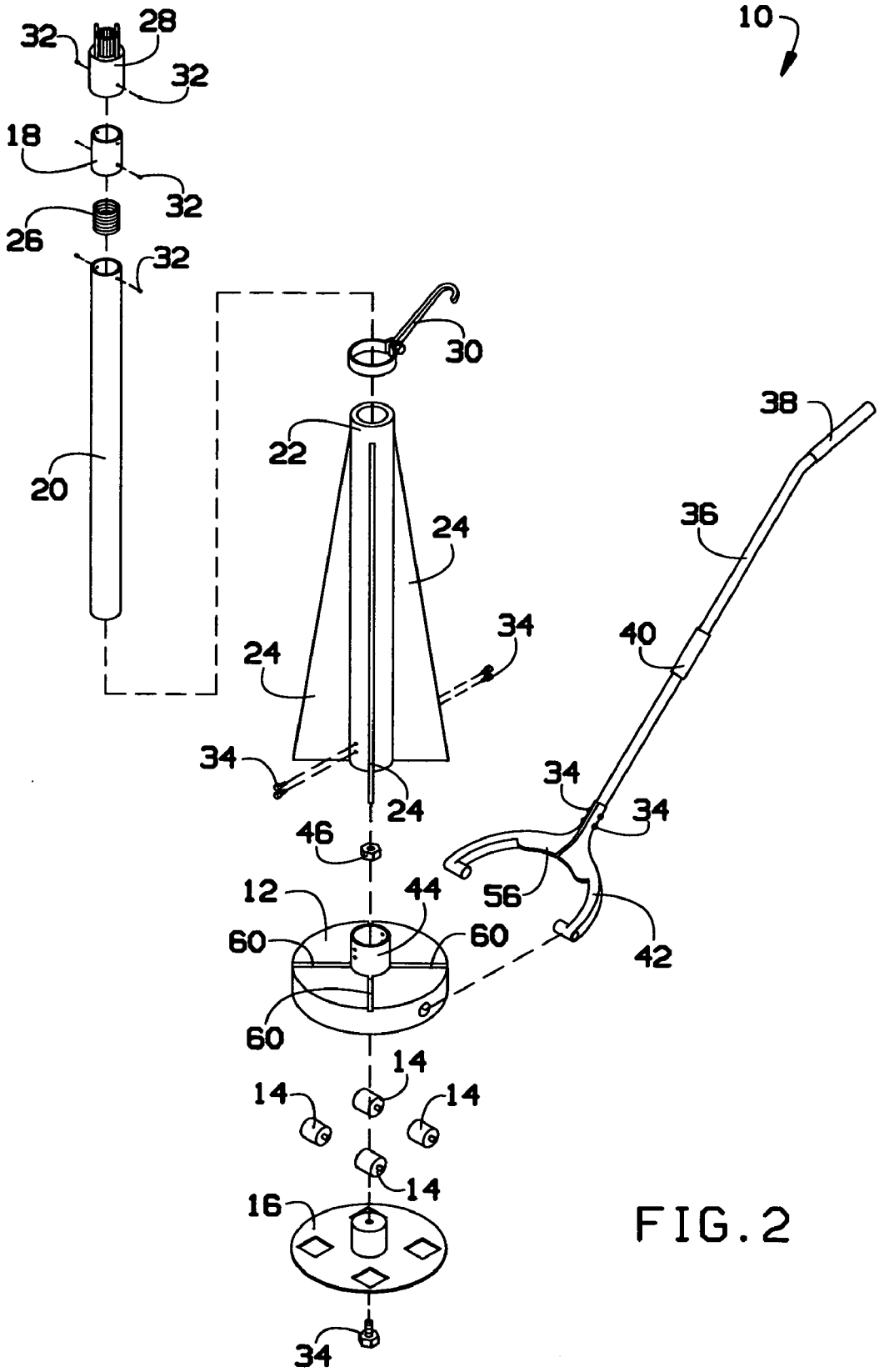
FIG. 2 is an exploded perspective view of an exemplary embodiment of the invention.
Figure 6:
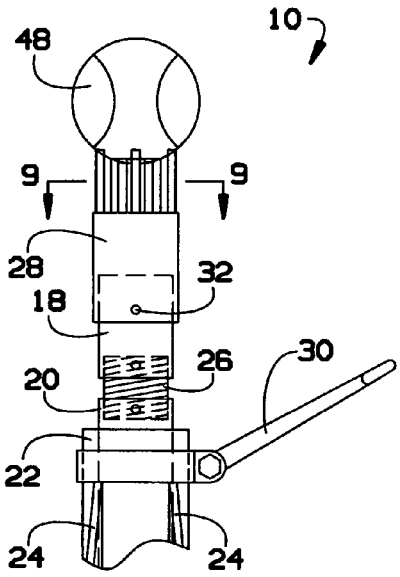
FIG. 6 is a detail side view of an exemplary embodiment of the invention illustrating the top of the device.
Figure 7:
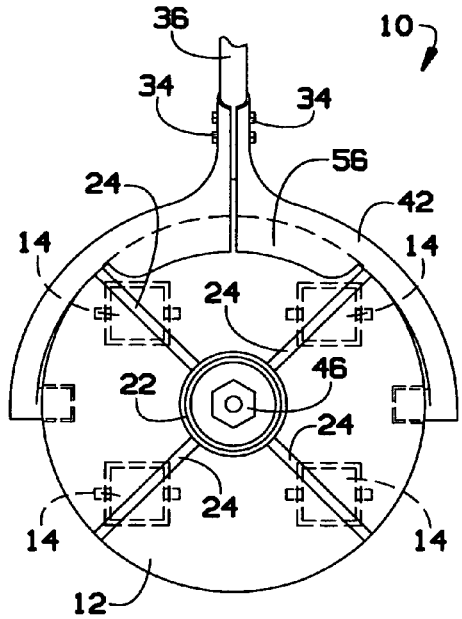
FIG. 7: is a detail top view of an exemplary embodiment of the invention illustrating the base.
Figure 8:
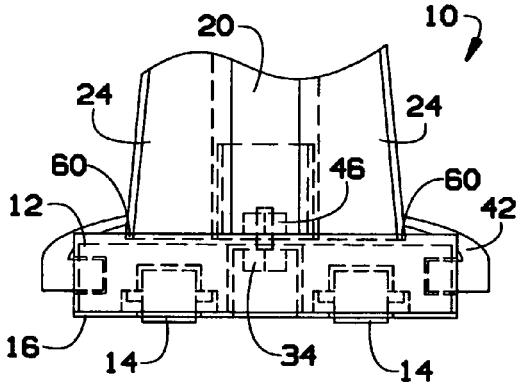
FIG. 8: is a detail front view of an exemplary embodiment of the invention illustrating the base.
Figure 9:
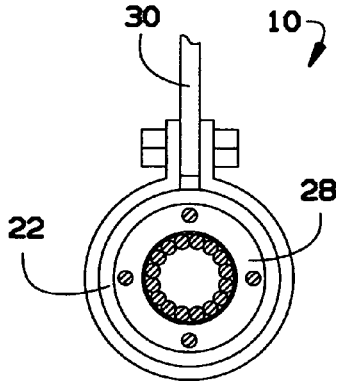
FIG. 9: is a section view of an exemplary embodiment of the invention taken along line 9-9 in FIG. 6 to illustrate the spacing of the bristles.
Figure 10:
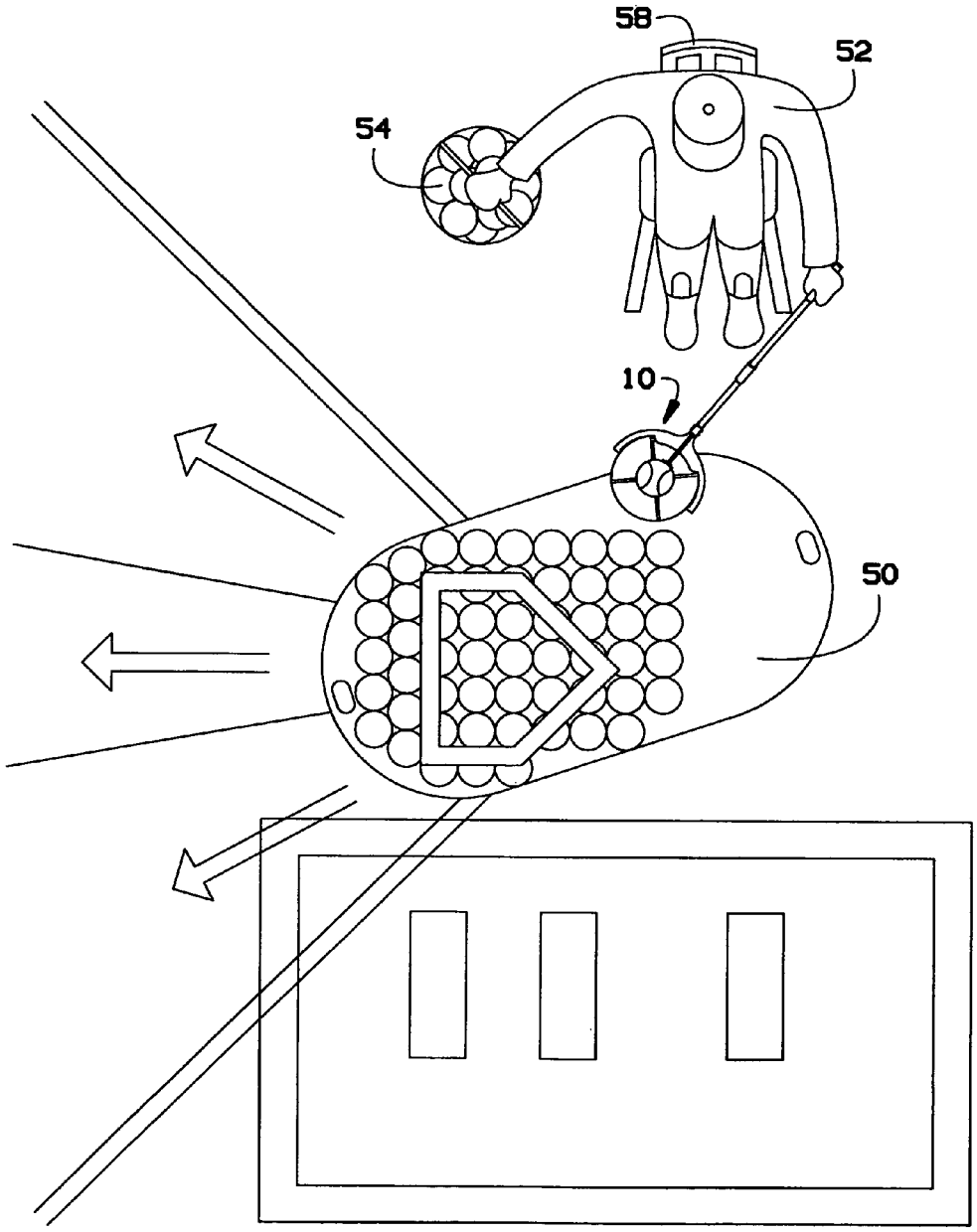
FIG. 10: a top view of an exemplary embodiment of the invention in use with the illustrated board 50.

10: is the overall invention.
12: is the base.
14: is the wheel.
16: is the bottom base cover.
18: is the upper stem.
20: is the lower stem.
22: is the main body.
24: are the vanes.
26 is the spring.
28: is the head with bristles.
30: is the compression device.
32: are the rivets,
34: are the bolts.
36: is the adjustable handle.
38: is the hand grip.
40: is the compression nut.
42: is the [teo] two piece handle connector.
44: is the base connector.
46 is the nut.
48: is the ball.
50: is the illustrated board.
52: is the operator.
54: is the ball bucket.
56: is the lip.
58: is the chair.
60: are the support slots for the vanes 24.

FIELD OF INVENTION

The instant device is a baseball and/or softball batting tee that is a mobile batting tee. Using its adjustable length handle and the illustrated board that it moves upon, the tee can be pushed or pulled back and forth from the operator's sitting position to the home plate area with a ball atop the tee. This allows the operator to avoid moving over to the tee to place a ball on it for hitting. The positioning of the operator further from the batter is an important safety feature of the device. The device being mobile along with the use of an adjustable handle allows the operator to move the tee on top of the illustrated board to new locations without having to get up from their position to do so. The system uses a stationary board with illustrations that show the batter which direction to hit balls of all different locations within the strike zone. By using the device in successive repetitions while each time locating the ball in a different location within the illustrated strike zone, the batter does not have the opportunity to change their stance or balance. By operating the device in this manner, the batter is forced to find a neutral stance and balance to hit balls bf all locations. This teaches batters the proper hitting mechanics to hit balls to all fields.

BACKGROUND OF INVENTION

Baseball and softball batting tees have long been used as stationary devices that required an operator to step over or reach over to a baseball tees location so that a ball can be placed on it for hitting. This is tiresome and dangerous for the operator because it places the operator within reach of the batter who may inadvertently swing a bat. Batting tees typically are only moveable when the operator steps over or leans over to the tee and moves it by hand to a new location. If the operator is kneeling sitting or standing nearby it causes them to get up, step over or reach for the tee every time they want to change the batting tee's location. Current devices don't address the problem of teaching which direction to hit balls of different locations within the strike zone. Current devices don't teach the proper stance, weight balance, or mechanics to hit balls of differing locations to all fields.

SUMMARY OF THE INVENTION

The instant device is a baseball and/or softball batting tee that is a mobile batting tee. Using its adjustable length handle and the illustrated board that it moves upon, the tee can be pushed or pulled back and forth from the operator's sitting position to the home plate area with a ball atop the tee. This allows the operator to avoid moving over to the tee to place a ball on it for hitting. The positioning of the operator further from the batter is an important safety feature of the device. The device being mobile along with the use of an adjustable handle allows the operator to move the tee on top of the illustrated board to new locations without having to get up from their position to do so. The system uses a stationary board with illustrations that show the batter which direction to hit balls of all different locations within the strike zone. By using the device in successive repetitions while each time locating the ball in a different location within the illustrated strike zone, the batter does not have the opportunity to change their stance or balance. By operating the device in this manner, the batter is forced to find a neutral stance and balance to hit balls of all locations. This teaches batters the proper hitting mechanics to hit balls to all fields.

DETAILED DESCRIPTION OF THE INVENTION

The following detailed description is of the best currently contemplated modes of carrying out exemplary embodiments of the invention, invention. The description is not to be taken in a limiting sense, but is made merely for the purpose of illustrating the general principles of the invention since the scope of the invention is best defined by the appended claims.

Broadly, an embodiment of the present invention generally is a baseball and/or softball batting tee that is a mobile batting tee.

Elements of the device comprise a round base (12) with wheels (14) or plastic slides with recessed holes, a main body (22) with vanes (24) and a connector and compression device (30), a two piece stem, a spring (26), a head (28) with 2 different sets of bristles each set of different size, rivets (32) and bolts (34), an adjustable handle (36) with a rubber or plastic grip (38) and a compression nut (40) or device, a two-piece half circle shaped handle connector (42) with lip (56), and an illustrated board (50). Optional elements include adjustable feet for the illustrated board (50), plastic slides instead of wheels (14), and a compression device with a handle instead of the compression nut (40) located on the top of the main body (22). The head (28) is a plastic tube with one closed end that has groups of nylon type bristles in a circled row.

These bristles, along with a second set of bristles located outside the first at the four corners support the ball (48) for hitting. These sets of bristles stabilize the ball (48) on top of the tee while it is being moved back and forth from the operator's sitting position on a chair (58) to the home plate area where it will be hit by the batter. The stem is made of two tubes of the same diameter plastic: one short and one long joined by a shock absorbing spring (26). The stem is the part that slides up and down within the main body (22) and has the head (28) mounted atop it. The main body (22) is the rocket-looking part of the tee that has a slightly larger diameter tube than the stem that slides within it.

The main body's design is one of a tube with four equally spaced vanes (24) that run down the sides of it for stability and forms the shape of a rocket. Near the top of the main body (22) is a compression nut (40) or device that compresses the tube of the main body (22) and the stem within it, making the stem stationary during use. Inside the main body's tube at the bottom is a cup-shaped connector (44).

The connector (44) is mounted in the bottom of the main body's tube by rivets (32) or bolts (34) and has a threaded nut (46) in center for the bolt. There is a bolt that is inserted from the bottom of the base (12) and through it to the base connector (44) and is fastened by the nut (46).

The base (12) is circular in shape and is of a heavier weighted material than the main body (22) for stability. It can be plastic with a ballast-filled cavity or can be made of a solid metal. It has a hole in the center for the base connector (44) bolt to pass through, as well as pockets located in the bottom for four wheels (14) or sliding devices making it mobile. There can be a base cover (16) at the bottom of the base. There are also two opposing pocket holes on each side of the base (12) that allow the connection of the adjustable handle connector (42). On the top of the base (12) there are four grooves in which vanes (24) rest. A spring (26) connects both sections of the stem, the upper stem (18) that connects to the head (28) and the lower stem (20) that slides within the main body (22). There are wheels (14), plastic slides or other devices that are mounted on the bottom of the base (12) that allow the device to be moved.

The adjustable handle (36) is attached to the base (12) on either side using a connector. The handle (36) comprises two aluminum or plastic tubes of different .diameters in which the smaller slides inside the larger making it adjustable in length. It has a grip (38) attached and a compression nut (40) that is used to secure the two tubes during use. An adjustable handle connector (42) is two curved tubes that connect the base (12) to the larger tube of the adjustable handle (36). There are bolts (34), nuts and/or rivets (32) used as fasteners. The ends of the connector are inserted into the base pocket holes and rotate within the base (12) allowing movement of the handle (36) up or down.

The board (50) is an irregularly shaped flat sheet of material that is made of wood, plastic, metal or composite material 151 that supports the device and allows for its movement between the operator (52) and the home plate area. This board (50) is reversible and illustrated on both sides for the purpose of training both left and right handed hitters. It is illustrated with a home plate design, and numbered circles that identify all pitch locations within the strike zone. The illustrated board (50) is numbered so as to facilitate the quality and quantity of a speedy practice. Each batter, regardless of size or stance, can identify locations on the board (50) that work the best for them. When the operator (52) positions the tee in those locations, especially in a random sequence, the batter gets a much better workout and dramatically increases their abilities. In a team setting this saves much needed time when going from player to player as it teaches many players in a shorter time.

The strike zone is separated into three colors identifying balls to be hit to left, center and right fields showing the batter which direction to hit all pitches regardless of their location. The base connector (44) is a metal tube several inches in length that is closed at the bottom end with threads or a nut (46) welded in the center where the hole is located. This allows the main body (22) to be bolted to the base (12) by attaching the connector to the bottom of main body (22) tube by means of bolts (34) or rivets (32) and then attaching the main body (22) to the base (12) by means of a bolt that runs through the base (12) into the nut (46) or threads located in the base connector (44).

Located at the top of the device is the head (28) with two sets of nylon bristles that support and stabilize the ball (48). The head (28) is connected to the upper stem (18). The upper (18) and lower (20) stems are joined with a spring (26) that allows movement of the head (28) apart from the main body (22). The lower stem (20) is positioned inside the main body's tube and is held in place by a compression device (30) located at the top. When tightened the compression device (30) causes the stem to be stationary within the main body (22) so that the stem cannot move up or down. Adjustments in ball (48) height are done by releasing the compression device (30) and pulling up or pushing down on the stem within the main body (22) and then retightening the compression device (30) or nut.

The main body (22) is a rocket-shaped piece with an inner tube of slightly larger inside diameter than the outside diameter of the stem and is made of plastic or metal. It has four vertical vanes (24) equally spaced along the outside of the tube that stabilize the tee. The main body (22) is connected to the base (12) by setting its vanes (24) into the grooves located on top of the base (12) and by screwing a bolt through the bottom of the base (12) into the base connector (44) located within the main body's tube. On the bottom of the base (12) there are recessed wheels (14) with small reveal or plastic slides for easy movement. There are pocket holes on opposite sides of the base (12) for mounting the adjustable handle (36) via its two-piece connector. The adjustable handle (36) when connected to the base (12) is used to push the entire tee around on the illustrated board (50).

The illustrated board (50) is a shaped flat surfaced sheet of plastic, wood or metal, or can be molded plastic that acts as a foundation for the tee to be moved around on. It has illustrations on both sides showing the home plate location as well as numbered circles that represent different pitch locations as well as colored areas that show the direction each pitch location should be hit. The illustrated board (50) is placed with one end covering home plate and the other located in or near the opposing batter's box. The operator (52) sits at one the end of the board (50) opposite the home plate end. With the adjustable handle (36) of the device in one hand the operator (52) uses his other hand to place a ball (48) on top of the tee's head (28). Then using the adjustable handle (36), the operator (52) pushes the tee that is resting on top of the illustrated board (50) to a marked location at the other end of the illustrated board (50). This movement is facilitated by use of wheels (14) or plastic slides located on the bottom of the base (12). The batter then hits the ball (48) off the tee. Any shock normally caused by the impact of the bat on the ball (48) or the tee's head (28) is absorbed by the spring (26) located in the stem. After the batter hits the ball (48), the operator (52) using the adjustable handle (36) draws the tee back and loads another ball (48) from a ball bucket (54) onto the tee and the cycle is repeated.

The operator (52) may decide to change locations by rolling or sliding the tee to a new location on top of the illustrated board (50). The operator (52) may also decide to change the height of the ball (48) by loosening the compression device located near the top of the main body (22) then raising or lowering the stem. This would give the hitter a new ball (48) height to practice. It is important that the tee be stable during use. The vanes (24) keep the main body (22) erect. The compression device (30) located at the top of the main body (22) stabilizes the stem from moving up or down during use. The spring (26) isolates the shock of batted ball (48) from the main body (22). The base connector (44) firmly connects the main body (22) on top of the base (12). The grooves on top of base (12) are recessed. Positioning the vanes (24) in these grooves keeps the vanes (24) in place while stabilizing the tee. The four wide wheels (14) stabilize the tee both at rest and when being moved.

The base (12) is stabilizing in two ways: A) Its heavier weight counterbalances the effects of the taller main body (22) and stem with head (28), and B) when the tee is mishit and begins to lean over, the base (12) comes into contact with the top of the illustrated board (50) further keeping it from being tipped over. The base connector (44) and bolt located at the bottom of the tube of the main body (22) firmly connects the main body (22) to the base (12). The adjustable handle (36) with its handle connector (42) stabilizes the tee in two respects: A) by locating the handle connector (42) to both sides of the base (12) an operator (52) can counteract the swaying or tipping over of the tee from side to side, and. B) located in the center of the handle connector (42) is a lip (56) that comes into contact with the top of the base (12) when the tee is being tipped in a direction away from the operator (52). The operator (52) using the leverage of the handle (36) in conjunction with this lip (56) keeps the tee from tipping over. The illustrated board (50) stabilizes the tee by virtue of its flat surface and when placed over uneven ground or surface, allows the tee to be moved smoothly without dislodging the ball (48).

Stabilizing the ball (48) is done by use of the outer and taller bristles of the tee head (28). These bristles stabilize the ball (48) during movement of the tee from the operator's location to the hitting area. Some portions of the device are made up of plastic parts that can be formed through rotational molding, injection molding, plastic extrusion or welded plastic. Metal parts such as the base (12), the handle connector (42) and handle (36) are extruded aluminum, cast aluminum or cast steel. The main body's tube may be extruded and vanes (24) cut from flat stock and joined to the tube by use of slots and or adhesives. Otherwise the main body (22) with vanes (24) is made from injection or rotational molding as a one piece unit. The two piece stem is injection molded or extruded. The illustrated board (50) is made of flat stock, molded plastic, or cut from sheet metal, laminate or composite material. Wheels (14), springs (26), compression nuts (40), bolts (34) and rivets (32), grips (38), are purchased whole from suppliers. The base (12) is made of, cast aluminum, cast steel, or machined from portions of solid aluminum rounds, or made of a ballast-filled plastic cavity. The adjustable handle (36) is formed from two diameters of aluminum tubing, one slightly larger than the other To assemble the device, the base connector (44) is fastened inside the lower end of the main body's tube by bolts (34) or rivets (32). Then the main body (22) is attached to the base (12) by placing the vanes (24) of the main body (22) into the recessed grooves on top of the base (12). The main body (22) is then fastened to the base (12) by a bolt that runs through the center of the bottom of the base (12) into the threaded base connector (44) located in the bottom of the main body's tube. The two-piece stem is assembled by mounting the spring (26) inside the ends of both pieces forming a single unit then connecting the head (28) to the top of the smaller of the two stem pieces.

The two piece stem with spring (26) and head (28) attached is then pushed inside the main body's tube from the top. The four wheels (14) are attached to the bottom of the base (12) in their recessed pockets. The ends of two piece handle connector (42) are positioned inside the holes located on each side of the base (12). Then the adjustable handle (36) with grip (38) is bolted together with the handle connector (42).

The illustrated board (50) is cut from flat stock in two pieces or molded in two pieces with illustrations incorporated into the molding process, or laminated or applied afterward. Then both pieces are joined by a hinge. Both sides of both pieces of the board (50) are illustrated, one side for left handed hitters and one side for right handed hitters. The illustrated board (50) is made in two pieces connected by a hinge in the middle that facilitates folding. There is a hand hole located at both ends. When the illustrated board (50) is folded in half these hand holes face together making it convenient to carry also contemplated is the method of using the device to train batters. In order to use the device on a typical baseball or softball field with batter's boxes and a home plate, the operator (52) locates the end of the board (50) with the illustrated home plate over the field's home plate. The other end of the board (50) is placed at a location opposite from the batter.

The operator (52) takes a ball (48) and places it on top of the batting tee's head (28) and then by using the adjustable handle (36), pushes the tee from the operator's end of the board (50) to the other end where the illustrated home plate and simulated strike zone is located the batter hits the ball (48) off the tee. Then the operator (52) pulls the tee back to the operator's end of the board (50) to load another ball (48) and the cycle is repeated. The operator (52) can change the locations between swings to simulate different pitch locations or may change the height of the ball (48) by releasing the compression device (30) on the stem and pulling or pushing the stem higher or lower within the main body (22) creating a higher or lower ball (48) location from which to hit. For left handed batters the two sided illustrated board (50) is turned over and the operator (52) relocates to the opposite batter's box from the hitter. This will change the operator's location to the other side. The operator (52) locations can be adjusted to make it easier to operate from.

The device can be used in smaller areas with the use of a net, backstop or catch device. If used on a hard surface like gym floor or concrete patio the device can be used without the board (50) by painting the illustrated home plate and strike zone locations directly onto the surface. For a temporary use of a hard surface the illustrations could be marked using chalk on the floor's surface. In an alternative embodiment, when training younger players who have never faced live pitching the operator (52) can place an extension to the illustrated board (50) in front of the existing illustrated board (50) extending towards the pitcher's mound. The operator (52) using the adjustable handle (36) while fully extended could simulate a pitch by slowly bringing the tee carrying the ball (48) towards home plate. This would allow the ball (48) to be hit by the batter while moving slowly. By simulating a slow pitch the young batter can develop confidence to hit a moving ball (48) without actually facing live pitching.

It should be understood, of course, that the foregoing relates to exemplary embodiments of the invention and that modifications may be made without departing from the spirit and scope of the invention as set forth in the claims.

I claim:

1. A mobile ball batting tee comprising:

a hollow tubular main body having an upper end, a lower end and a mid-section, wherein the mid-section includes a plurality of vanes;

a two-piece stem having an upper section and a lower section, a spring interposed between the upper section and the lower section of the stem, wherein the two-piece stem is slidably received within the hollow tubular main body;

a head portion positioned at an outer end of the upper section of the stem, wherein a free-end of the head portion includes a plurality of bristles for supporting and stabilizing a ball;

a compression device having a handle positioned near an upper end of the hollow tubular main body, wherein the handle compresses against the hollow tubular main body and the two-piece stem, making the stem stationary;

a round base having an upper surface and a lower surface, a plurality of wheels attached to the lower surface;

the lower end of the tubular main body is removably received on the upper surface of the round base;

an adjustable handle having a hand grip on a first end and a handle connector on a second end, wherein the adjustable handle is releasably attached to the round base for pushing the batting tee;

an illustrated board positioned on a support surface, wherein the round base is moveably positioned on the illustrated board, such that an operator can easily move the mobile batting tee over the illustrated board.

2. The mobile batting tee of claim 1, wherein the illustrated board is reversible and includes illustration of a home plate as well as colored areas showing pitch direction on both an upper surface and a lower surface.

3. The mobile batting tee of claim 1, wherein the upper surface of the round base includes a plurality of support slots or grooves for receiving the plurality of vanes.

4. The mobile batting tee of claim 1, wherein the adjustable handle includes a compression nut for adjusting a length of the adjustable handle.

5. The mobile batting tee of claim 1, wherein the handle connector is a two-piece half circle-shaped connector.

6. The mobile batting tee of claim 1, wherein the round base is hollow and filled with ballast material; the round base further includes a central hole for receiving a base connector bolt on the upper surface and a plurality of pockets on the lower surface for receiving the plurality of wheels.

7. The mobile batting tee of claim 1, wherein the round base is made of a solid metal, the round base further includes a central hole for receiving a base connector bolt on the upper surface and a plurality of pockets on the lower surface for receiving the plurality of wheels.

8. The mobile batting tee of claim 1, wherein the plurality of wheels is a plurality of plastic slides.

9. The mobile batting tee of claim 1, wherein the round base further includes two opposing pocket holes on each side of the round base that allow the connection of the adjustable handle connector.

* * * * *